US007374852B2

(12) United States Patent
Yon et al.

(10) Patent No.: US 7,374,852 B2
(45) Date of Patent: May 20, 2008

(54) LIQUID TONER COMPOSITION AND PREPARATION METHOD OF THE SAME

(75) Inventors: Kyung-yol Yon, Seongnam-si (KR); Min-young Cheong, Seoul (KR); Ki-won Seok, Suwon-si (KR); Jung-wook Kim, Yongin-si (KR); Hae-ree Joo, Seoul (KR); Nam-jeong Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 500 days.

(21) Appl. No.: 11/113,234

(22) Filed: Apr. 25, 2005

(65) Prior Publication Data

US 2005/0244736 A1 Nov. 3, 2005

(30) Foreign Application Priority Data

Apr. 29, 2004 (KR) ..... 10-2004-0030219

(51) Int. Cl.
*G03G 9/08* (2006.01)

(52) U.S. Cl. ..... 430/115; 430/116; 430/137.22

(58) Field of Classification Search ..... 430/115, 430/116, 137.22

See application file for complete search history.

(56) References Cited

U.S. PATENT DOCUMENTS 3,926,825 A * 12/1975 Honjo et al. ..... 430/115
5,322,751 A 6/1994 Chou et al.

FOREIGN PATENT DOCUMENTS

| | | |
|---|---|---|
| JP | 62-18575 | 1/1987 |
| JP | 6-56946 | 3/1994 |
| JP | 2003-43750 | 2/2003 |
| JP | 2003-57883 | 2/2003 |
| JP | 2003-241440 | 8/2003 |
| KR | 1999-63760 | 7/1999 |

OTHER PUBLICATIONS

Korean Office Action for corresponding Korean Patent Application No. 10-2004-0030219 dated Jan. 24, 2006.

* cited by examiner

*Primary Examiner*—Mark A. Chapman
(74) *Attorney, Agent, or Firm*—Staas & Halsey LLP

(57) ABSTRACT

A liquid toner composition and a preparation method utilize a colorant, an organosol, a charge control agent, a carrier liquid, a dispersion assistant agent, and a photoreactive catalyst, in which the dispersion assistant agent is a polymer including an unsaturated functional group to cause photopolymerization in a presence of the photoreactive catalyst, and the photoreactive catalyst produces a free radical through an irradiation of light, and initiates the photopolymerization of the dispersion assistant agent. According to embodiments of the present invention, the toner organosol rarely affects the physical properties required of the liquid toner, and an offset error in a fixing operation is removed, resulting in an improved quality of a printed image.

17 Claims, 2 Drawing Sheets

LIQUID TONER COMPOSITION AND PREPARATION METHOD OF THE SAME

CROSS-REFERENCE TO RELATED APPLICATIONS

This application claims benefit under 35 U.S.C. § 119 from Korean Patent Application No. 2004-30219 filed on Apr. 29, 2004 In the Korean Intellectual Property Office, the entire content of which is incorporated herein by reference.

BACKGROUND OF THE INVENTION

1. Field of the Invention

The present invention generally relates to a liquid toner composition and a preparation method of the same. More specifically, the present invention relates to a liquid toner composition including an organosol whose dispersion assistant agent has an unsaturated double bond subjected to photopolymerization and a photoreactive catalyst for initiating the photopolymerization of the dispersion assistant agent to facilitate hardening of toner particles transferred onto a recording medium, consequently improving an overall print quality.

2. Description of the Related Art

A liquid toner composition is widely used for electrophotographic image forming apparatuses, such as, copiers, laser printers, and fax machines. These electrophotographic image forming apparatuses use electrically charged toner particles to print a desired image onto a recording medium.

There are two types of electrophotographic image forming apparatuses. One type includes the dry electrophotographic image forming apparatuses that use a dry toner, and the other type includes wet electrophotographic image forming apparatuses that use a liquid toner. The liquid toner, as compared with the dry toner, uses micro-fine toner particles, so that it features high resolution and high print speed. Moreover, the wet electrophotographic image forming apparatus uses a relatively smaller amount of toner and thus, the replacement period of the toner may be extended.

The liquid toner is prepared by dispersing toner particles onto an aqueous carrier. More specifically, a liquid carrier consists of toner particles including a colorant and a polymer as a binder resin, a charge control agent for controlling the charge on a toner particle, a liquid carrier wherein toner particles and the charge control agent are dispersed, and an optional additive for improving the performance of the toner.

FIG. 1 is a schematic diagram of a conventional wet electrophotographic image forming apparatus. A laser scanning unit (not shown) scans a laser beam onto each photosensitive drum 10 in the direction the arrow is pointing. As a result, an electrostatic latent image is formed on the surface of the photosensitive drum 10. Next, a toner inside a developer 50 comes in contact with the photosensitive drums to generate a visible image on the surfaces of the photosensitive drums. The image is transferred to an intermediate transfer belt 30. The image transferred to the transfer belt 30 passes through a fixing roller 60, and is fixed onto the recording medium as a permanent image.

According to the kind of binder resin used, the liquid toner for use in the wet electrophotographic image forming apparatus is generally divided into a liquid toner using a common resin, and an organosol toner using an organosol.

The toner organosol includes 0.1-10 micron diameter toner particles that are stably charged. Thus, high resolution images may be achieved.

However, a percentage of weight occupied by a carrier liquid in a conventional toner organosol is relatively high, so solid components in the toner often aggregate again, and this tendency makes it difficult to store the toner organosol at a high temperature for an extended period of time. To solve this problem, a liquid toner including a dispersion assistant agent has been developed, under the condition that the optical density (OD) of a printed image is maintained at a predetermined level. As for the dispersion assistant agent, a polymer material soluble in the liquid carrier has generally been used. Particularly, the most preferred material for the dispersion assistant agent is the (metha)acrylate (co)polymer because it rarely affects the liquid toner's own physical properties, but may improve the storage stability for an extended period of time.

However, the (metha)acrylate (co)polymer has a high viscosity. Therefore, when the (metha)acrylate (co)polymer is transferred onto the recording medium with other ingredients of the liquid toner, it adheres to the fixing roller as the recording medium passes through the fixing roller. Since parts of the toner particles remain and are not transferred onto the recording medium, the resolution of the finally fixed image on the recording medium deteriorates, and the printed portion is easily erased.

The (metha)acrylate (co)polymer adhered to the fixing roller continues to influence the printing operation later on, and deteriorates the print quality.

SUMMARY OF THE INVENTION

In an aspect of the present invention, a liquid toner composition and a preparation method of the same utilize a liquid toner composition that includes a dispersion assistant agent and a photoreactive catalyst that rarely affect the toner's own physical properties when utilized in an electrophotographic image forming apparatus, maintain dispersion stability for an extended period of time, and are hardened after being fixed onto a recording medium, thus improving the resolution of a printed image.

To achieve the above aspect and advantages, a liquid toner composition, comprises: a colorant, an organosol, a charge control agent, a carrier liquid, a dispersion assistant agent, and a photoreactive catalyst, wherein the dispersion assistant agent is a polymer including an unsaturated functional group to cause photopolymerization in a presence of the photoreactive catalyst, and the photoreactive catalyst produces a free radical through an irradiation of a light, and initiates the photopolymerization of the dispersion assistant agent.

Preferably, the amount of the organosol is within a range from 1 weight part to 20 weight parts with respect to 1 weight part of the colorant; the amount of the charge control agent is within a range from 0.001 weight part to 1 weight part with respect to 1 weight part of the colorant; the amount of the carrier liquid is within a range from 10 weight parts to 100 weight parts with respect to 1 weight part of the colorant; the amount of the dispersion assistant agent is within a range from 1 weight part to 20 weight parts with respect to 100 weight parts of a total weight of the colorant and the organosol; and the amount of the photoreactive catalyst is within a range from 1 weight part to 10 weight parts with respect to 100 weight parts of the dispersion assistant agent.

Preferably, the dispersion assistant agent is a polymer soluble in the carrier liquid, and includes a repetitive unit derived from $C_6$-$C_{30}$ (metha)acryl monomers, and an weight average molecular weight (Mw) of the dispersion assistant agent including a repetitive unit derived from a $C_6$-$C_{30}$ (metha)acryl monomer is in a range from 100,000 to 300,000.

Preferably, the $C_6$-$C_{30}$ (metha)acryl monomer is selected from a group consisting of hexyl(metha)acrylate, 2-ethylhexyl(metha)acrylate, 2-hydroxyethyl methacrylate, decyl (metha)acrylate, dodecyl acrylate, lauryl acrylate, octadecyl acrylate, stearyl acrylate, behenyl acrylate, and trimethyl cyclohexyl methacrylate.

Preferably, the photoreactive catalyst is selected from a group consisting of benzoin butyl ether, benzyl dimethyl ketal, α-aminoacetophenone, ethoxyacetophenone, acyloxime ester, chlorinated acetophenone, hydroxyacetophenone, phenylphospine oxide, acylphospine oxide, phosphine oxide, benzophenone, Michlers Ketone, dibenzosuberone, 2-ethylanthraquinone, isobutylthioxanthone, isopropylthioxanthone, benzyl, and thioxanthone. More preferably, the photoreactive catalyst is selected from a group consisting of benzyl dimethyl ketal, mixtures of benzyl dimethyl ketal and phosphine oxide, and mixtures of α-aminoacetophenone and thioxanthone.

Preferably, the organosol comprises a thermoplastic (co) polymer core that is insoluble in the carrier liquid, and a (co)polymer graft stabilizer that is covalently bonded to the thermoplastic (co)polymer core, and a mixture ratio of the (co)polymer core to the (co)polymer graft stabilizer is in a range from 1:1 to 15:1. The (co)polymer core-forming monomer is a $C_4$-$C_{30}$ (metha)acrylate monomer, and the (co)polymer graft stabilizer-forming monomer is a $C_6$-$C_{30}$ (metha)acrylate monomer.

In another aspect of the present invention, a preparation method of a liquid toner composition includes: preparing a graft stabilizer by blending in a first carrier liquid a graft stabilizer-forming $C_6$-$C_{30}$ (metha)acrylate monomer, and a first polymerization initiator to cause polymerization; preparing an organosol by blending in a second carrier liquid the graft stabilizer, a thermoplastic (co)polymer core-forming $C_4$-$C_{30}$ (metha)acrylate monomer, and a second polymerization initiator to cause polymerization; preparing a dispersion assistant agent by blending in a third carrier liquid a dispersion assistant agent-forming $C_6$-$C_{30}$ (metha) acrylate monomer, and a third polymerization initiator to cause polymerization; and blending in a fourth carrier liquid a colorant, the organosol, a charge control agent, the dispersion assistant agent, and a photoreactive catalyst for the reaction.

Preferably, the dispersion assistant agent-forming $C_6$-$C_{30}$ (metha)acrylate monomer is soluble in the fourth carrier liquid, and the dispersion assistant agent comprises an unsaturated functional group.

Preferably, the photoreactive catalyst is selected from a group consisting of benzoin butyl ether, benzyl dimethyl ketal, α-aminoacetophenone, ethoxyacetophenone, acyloxime ester, chlorinated acetophenone, hydroxyacetophenone, phenylphospine oxide, acylphospine oxide, phosphine oxide, benzophenone, Michlers Ketone, dibenzosuberone, 2-ethylanthraquinone, isobutylthioxanthone, isopropylthioxanthone, benzyl, and thioxanthone. More preferably, the photoreactive catalyst is selected from a group consisting of benzyl dimethyl ketal, mixtures of benzyl dimethyl ketal and phosphine oxide, and mixtures of α-aminoacetophenone and thioxanthone.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
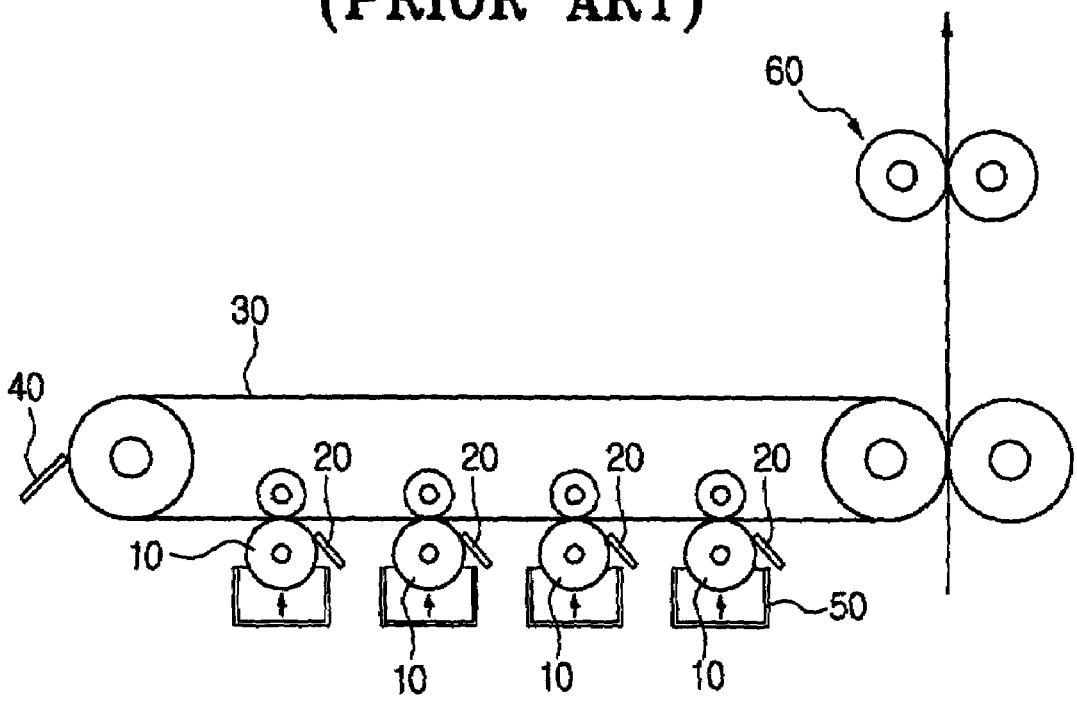
FIG. 1 (PRIOR ART)
FIG. 1 is a schematic diagram of a conventional wet electrophotographic image forming apparatus.

Reference will now be made in detail to the embodiments of the present invention, examples of which are illustrated in the accompanying drawings, wherein like reference numerals refer to the like elements throughout. The embodiments are described below to explain the present invention by referring to the figures.

A liquid toner composition according to an embodiment of the present invention includes toner particles having a colorant and an organosol, a charge control agent to control charge on a toner particle, a dispersion assistant agent to maintain the dispersibility of toner particles, a liquid carrier wherein a photoreactive catalyst to harden the dispersion assistant agent and the ingredients are dispersed, and optional additives to improve the performance of the liquid toner.

As for the colorant for use in the liquid toner composition, well-known or common colorants, that is, pigment colorants or dye colorants, may be utilized. It is known that the pigment colorants have better thermal stability and lightproofness than the dye colorants, so they are preferred as toner colorants.

Examples of the pigment colorants include color organic pigments including azo pigments, phthalocyanine pigments, basic dyes, quinacridone pigments, dioxazine pigments, and diazo pigment; inorganic color pigments including chromate, ferrocyanides, oxide, selenium sulfide, sulfate, silicate, carbonate, phosphate, and metal powder; inorganic block pigments including carbon black, or mixtures thereof, and the examples here are for illustrative purposes only.

In consideration of the environmental factor, it is typical to use organic pigments. Examples of organic pigments for use in the liquid toner composition of the present invention are as follows: Blue and/or green pigments: copper phthalocyanine, metal-free phthalocyanine including P.B. (Pigment Blue) 15, 15:1, 15:2, 15:3, 15:4, 15:6, 16, aluminum phthalocyanine, nickel phthalocyanine, vanadium phthalocyanine, or bridged phthalocyanine dimer/oligomer (Si-bridged phthalocyanine); Orange pigments: P.O. (Pigment Orange) 5, 13, 43, 71, and 72; Yellow pigments: P.Y. (Pigment Yellow) 12, 13, 17, 74, 83, 93, 146, 155, 180, and 185; Red pigments: P.R. (Pigment Red) 48, 57, 122, 146, 147, 176, 184, 186, 202, 207, 238, 254, 255, 269, 270, and 272; and Pigment mixture: P.V. 19/P.R. 122 or P.R. 146/147.

The above examples of the pigments are for illustrative purposes only.

An organosol is an organic sol that functions as a binder to bind a colorant, and as a dispersant to disperse toner particles in a carrier liquid. Particularly, the organosol according to an embodiment of the present invention comprises a core that is insoluble in the carrier liquid, and a graft stabilizer covalently bonded to the core. The graft stabilizer of the organosol comprises a monomer that is soluble in the carrier liquid, and the organosol core comprises a monomer that is insoluble in the carrier liquid.

For the preparation of an organosol, a graft stabilizer is first prepared by mixing a graft stabilizer-forming monomer with a first polymerization initiator, blending in a first carrier liquid, and then subjecting the blended mixture to polymerization. Next, the graft stabilizer, a core-forming monomer, and a second polymerization initiator are blended in a second carrier liquid, and are subjected to polymerization, to prepare the organosol. The graft stabilizer is grafted to the core, and thus, stabilizes the toner particles.

Generally, $C_6$-$C_{30}$ (metha)acryl monomers are used in forming the graft stabilizer. Examples of the graft stabilizer-forming monomers include alkyl acrylates, alkyl methacrylates, ethylene, propylene, acryl amid, aryl acrylates, aryl methacrylates, alpha-olefin polymer, straight-chain or branched alkyl vinyl ether or vinyl ester, long-chain alkyl isocyanates, polysiloxane and polysilane, polymerized synthetic waxes, or mixtures thereof. These examples are for illustrative purposes only.

Typically, $C_4$-$C_{30}$ (metha)acryl monomers are used in forming the organosol core. Examples of the core-forming monomers include methyl acrylate, ethyl acrylate, butyl acrylate, methyl methacrylate, ethyl methacrylate, butyl methacrylate, trimethyl cyclohexyl methacrylate, behenyl acrylate, octadecyl acrylate, or mixtures thereof. These examples are for illustrative purposes only.

Examples of the first polymerization initiator for use in forming the graft stabilizer, and the second polymerization initiator for use in forming the organosol, include water-soluble or oil-soluble persulphates, peroxide, azobis compound, or mixtures thereof. But, these examples are for illustrative purposes only.

Examples of the first carrier liquid for use in forming the graft stabilizer, and the second carrier liquid for use in forming the organosol include aliphatic hydrocarbon, cyclic hydrocarbon, aromatic hydrocarbon, halogenated hydrocarbon solvent, silicon oils and waxes, polyethylene wax, stearic acid amide, or mixtures thereof, These examples are for illustrative purposes only.

A weight ratio of the mixture of the core and the graft stabilizer in the organosol is preferably in a range of 1:1 to 15:1. If the ratio of core/shell is greater than 15, the graft stabilizer for forming a three-dimensionally stable organosol will not be sufficient to aggregate the organosol. Meanwhile, if the ratio of core/shell is less than 1, polymerization does not take place and thus, the shell and the core cannot form an organosol dispersion, and exist as individual particles in the solution.

Generally, the liquid toner composition according to an embodiment of the present invention includes between 1 and 20 weight part of the organosol with respect to 1 weight part of the colorant. If the liquid toner composition includes less than 1 weight part of the organosol, the weight percent of the colorant is relatively increased. As a result, the organosol cannot fully function as a binder for the colorant. If the liquid toner composition includes greater than 20 weight parts of the organosol, the weight percent of the colorant is relatively decreased. As a result of this, the contrast of the printed image deteriorates.

Meanwhile, the charge control agent is an additive for use in controlling the charge on a toner particle. The charge control agent chemically reacts with the toner particle, or is bound to the toner particle through diverse methods, such as, chemical or physical adsorption, or formation of a chelate on a specific functional group of the toner particle.

Any well-known conventional charge control agent may be used in the liquid toner composition of the invention. Examples of the charge control agent include metal salts of fatty acids, a metal salt of sulfo-succinate, a metal salt of alkyl benzene sulfonic acid, a metal salt of aromatic carboxylic acid, a metal salt of sulfonic acid, polyoxyethylene alkylamine, lecithin, polyvinylpyrrolidone, basic barium petronate, and calcium petronate. A commercially available charge control agent is a zirconium HEX-CEM produced by MOONY CHEMICALS, CO., in Cleveland, Ohio, U.S.A.

Typically, the content of the charge control agent is in a range of 0.001 to 1 weight part with respect of the 1 weight part of the colorant. If the content of the charge control agent is out of the range, it becomes very difficult to control the charge on the toner particle and obtain a desired image. Also, the optical density of the image is lowered, and thus, a sharp, clear image is not obtained.

The liquid toner composition according to an embodiment of the present invention also includes a dispersion assistant agent to maintain the dispersibility of the toner composition for an extended period of time. An appropriate dispersion assistant agent is soluble in the carrier liquid of the liquid toner composition of the invention, and should be bound to a toner particle, namely, a colorant and/or organosol, chemically or physically, to be able to disperse the toner particle in the carrier liquid.

The dispersion assistant agent for use in the liquid toner composition includes a repetitive derivative unit of $C_6$-$C_{30}$ (metha)acrylate monomers, and its weight average molecular weight is preferably in a range from 100,000 to 300,000. Examples of the dispersion assistant agent-forming monomer include hexyl(metha)acrylate, 2-ethylhexyl(metha)acrylate, 2-hydroxyethyl methacrylate, decyl(metha)acrylate, dodecyl acrylate, lauryl acrylate, octadecyl acrylate, stearyl acrylate, behenyl acrylate, and trimethyl cyclohexyl methacrylate, or mixtures thereof. The thusly formed monomer is blended with a third polymerization initiator in a third carrier liquid, and is subjected to polymerization to prepare the dispersion assistant agent.

The material of the third polymerization initiator for use in preparation of the dispersion assistant agent is the same as the material of the first or the second polymerization initiator. Moreover, the third carrier liquid is homogeneous with the first or the second carrier liquid.

The same process used for the graft stabilizer of the organosol toner is applied to the preparation of the dispersion assistant agent included in the liquid toner composition of the present invention. The dispersion assistant agent has a high viscosity that enables the agent to be chemically, physically bound to the toner particle. But, this viscosity also causes toner particles or other particles included in the liquid toner composition to be adhered onto a fixing roller when a recording medium passes through the fixing roller of the image forming apparatus. As a result, the image quality printed on the recording medium deteriorates, and the remaining dispersion assistant and toner particles adhered onto the fixing roller deteriorate the subsequent print process.

The dispersion assistant agent included in the liquid toner composition includes an unsaturated functional group that is subjected to photopolymerization in the presence of a photoreactive catalyst. The same process is applied for the preparation of the dispersion assistant agent and the graft stabilizer, so the two components have very similar structures, except that the unsaturated functional group in the graft stabilizer provides a polymerization site for the unsaturated functional group and the core-forming monomer, while the unsaturated functional group in the dispersion assistant agent provides a photopolymerization site with the aid of a photoreactive catalyst.

The liquid toner composition of the invention includes a photoreactive catalyst to catalyze the photopolymerization of the unsaturated functional group in the dispersion assistant agent. The photoreactive catalyst is also called a photoreactive catalyst. A typical example is a radical photoreactive catalyst to produce a free radical with the aid of a light in a specific wavelength band. The photoreactive catalysts may be divided into radical photoreactive catalysts, cationic photoreactive catalysts, and anionic photoreactive catalysts, and may be optionally used according to components of an object photopolymerization resin. Even though the radical photoreactive catalyst is suitable for use in the dispersion assistant agent, which is a photopolymerization resin, other initiators may also be utilized by selectively changing the kind of resin to be used as a dispersion assistant agent.

Also, the radical photoreactive catalysts are largely divided into two types: $P_1$ and $P_2$ type.

$P_1$ type is an intermolecular photocleavage type, and a typical example of a $P_1$ type has an acetophenone structure as shown in Chemical Formula 1:

Chemical Formula 1

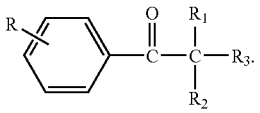

The photoreactive catalyst having the acetophenone structure excites a sufficient energy for breaking the intermolecular chemical bond at 71-73 kcal/mol, and the photoinitiator in the triplet state undergoes intermolecular decomposition to form a radical. This type of photoinitiator is rarely affected by viscosity. Examples of the $P_1$ type photoinitiator include benzoin butyl ether (R=H, $R_1$=$OC_4H_9$, $R_2$=H, $R_3$=$C_6H_5$), benzyl dimethyl ketal (R=H, $R_1$=$OCH_3$, $R_2$=$OCH_3$, $R_3$=$C_6H_5$), ethoxyacetophenone (R=H, $R_1$=$OC_2H_5$, $R_2$=$C_2H_5$, $R_3$=H), acyloxime ester (R=H, $R_1$=NOCO, $R_2$=$CH_3$, $R_3$=$C_6H_5$ or R=H, $R_1$=NOCO, $R_2$=$OC_2H_5$, $R_3$=$CH_3$), chlorinated acetophenone (R=$C_4H_9$, $R_1$=Cl, $R_2$=Cl, $R_3$=Cl), hydroxyacetophenone (R=H, $R_1$=OH, $R_2$=$CH_3$, $R_3$=$CH_3$), acylphospine oxide, α-amino acetophenone, chlorinated acetophenone, phenylphospine oxide, and phosphine oxide.

The $P_2$ type photoreactive catalyst has a thioxanthone structure expressed in the following Chemical Formula 2. Its excitation energy is 69 kcal/mol, which is insufficient to break the intermolecular bond. Thus, the photoreactive catalyst in the triplet state forms a hydrogen donor and a complex, and a hydrogen atom shifts to a photoinitiator molecule to form a radical.

Chemical Formula 2

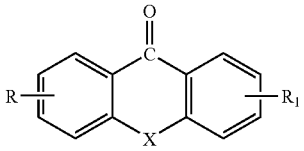

The hydrogen donor of the $P_2$ type photoreactive catalyst is usually an amine, and its effects are determined according to the molecular structure thereof. Compared to the $P_1$ type photoreactive catalyst, the $P_2$ type photoreactive catalyst is not obstructed by oxygen as long as the amount of amine is sufficient. However, it has also deficiencies, for example, the rate of polymerization is very low, storage stability of the resin compositions is deteriorated, and it is susceptive to viscosity. Therefore, if the viscosity is high, the dispersion speed is lowered, thus, decreasing the reaction rate. Examples of the $P_2$ type photoreactive catalyst include benzophenone (X=C, R=R, $R_1$=H), Michlers Ketone (X=C, R=$(CH_3)_2N$, $R_1$=$(CH_3)_2N$), dibenzosuberone (X=$CH_2$—$CH_2$, R=H, $R_1$=H), 2-ethylanthraquinone (X=C=O, R=H, $R_1$=2-$C_2H_5$), isobutylthioxanthone (X=S, R=H, $R_1$=2-1-$C_3H_7$), isopropylthioxanthone, and benzyl.

Preferable examples of the photoreactive catalyst include benzyl dimethyl ketal, mixtures of benzyl dimethyl ketal and phosphine oxide, and mixtures of α-aminoacetophenone and thioxanthone. The benzyl dimethyl ketal forms two radicals, both functioning as a polymerization initiator. Therefore, it has effective reactivity and storage stability, a high hardening speed, and a broad applicability of a subject resin. However, there is a possibility of radical self-polymerization, so it is preferable to add a phosphine oxide to the benzyl dimethyl ketal. Meanwhile, the mixture of the α-aminoacetophenone and thioxanthone has advantages in that the coloring is lower than other mixtures, the mixture may be more effectively used for white paint, and suppression of oxygen does not readily occur.

In the case of the mixture of benzyl dimethyl ketal and phosphine oxide, the weight percentage of phosphine oxide is preferably in a range from 10-40 weight parts with respect to 100 weight parts of benzyl dimethyl ketal. In case of the mixture of α-aminoacetophenone and thioxanthone, the weight percentage of thioxanthone is preferably in a range of 10-40 weight parts with respect to 100 weight parts of α-aminoacetophenone.

Commercial photoreactive catalysts (or photoreactive catalysts) are available from CIBA SPECIALTY CHEMICALS INC., including IRGACURE 184, IRGACURE 369, IRGACURE 500, IRGACURE 651, IRGACURE 727LP, IRGACURE 819, IRGACURE 907, IRGACURE 1000, IRGACURE 1700, IRGACURE 1800, IRGACURE 2005, IRGACURE 2010, IRGACURE 2959, DAROCUR 1173, DAROCUR 4265, DAROCUR BP, DAROCUR MBF, or mixtures thereof.

When a light is irradiated onto the photoreactive catalyst, a radical is formed, and the radical reacts with an unsaturated functional group in the dispersion assistant agent, resulting in polymerization. Examples of the light that is capable of activating the photoreactive catalyst (or photoreactive catalyst) include ultraviolet rays, electron beams, X-rays, infrared rays, visible lights, and other kinds of laser beams (that is, excimer laser, $CO_2$ laser, argon laser). Among these examples, ultraviolet rays are more preferably used. If an activation energy for the photoreactive catalyst and changes in the physical properties of a toner particle after the light irradiation are taken into consideration, it turns out that a light at wavelength of 200 nm-500 nm is the most desirable one.

Preferably, the ultraviolet ray is irradiated onto the recording medium before the image-bearing recording medium passes through the fixing roller because when the ultraviolet ray is irradiated onto the photoreactive catalyst in the liquid toner composition of an image transferred onto the recording medium, a free radical is formed. By this free radical, the unsaturated functional group of the dispersion assistant agent is readily photopolymerized, and is hardened onto the recording medium with each toner particle. Thus, when the recording medium passes through the fixing roller, the toner particles are not adhered to the roller.

A preferable weight percentage of the dispersion assistant agent included in the liquid toner composition of the invention ranges from 1-20 weight parts with respect to the total weight 100 weight parts of the solid toner particles, that is, the solid of colorant and organosol. If the content of the dispersion assistant agent is less than 1 weight part, the dispersion assistant agent cannot fully function as a dispersion assistant agent. Meanwhile, if the weight percentage of the dispersion assistant agent is greater than 20 weight parts, charge characteristics of the toner particles are deteriorated and thus, the image contrast is decreased.

Also, a preferable content of the photoreactive catalyst (or the photoreactive catalyst) included in the liquid toner composition ranges from 1-10 weight parts with respect to 100 weight parts of the dispersion assistant agent. If the weight percentage of the photoreactive catalyst is less than 1 weight part, sufficient photoradicals are not formed and as a result, a high level of polymerization of the dispersion assistant agent is not achieved. If the weight percentage of the photoreactive catalyst is greater than 20 weight parts, however, photoradicals are used not only for photopolymerization of the dispersion assistant agent, but also for attaching toner particles. This consequently changes the physical properties of the liquid toner.

In short, to prepare the liquid toner composition, the organosol, the dispersion assistant agent, the colorant, and the charge control agent are blended in a fourth carrier liquid in the presence of the photoreactive catalyst. The carrier liquid for use in the liquid toner composition needs to be chemically inert with respect to materials or devices used in the image forming apparatus.

Examples of the carrier liquid applicable to the liquid toner composition according to an embodiment of the present invention include aliphatic hydrocarbon including n-pentane, hexane, and heptane; cyclic hydrocarbon including cyclopentane, and cyclohexane; halogenated hydrocarbon solvent including aromatic hydrocarbon, that is, benzene, toluene, and xylene, chlorinated alkane, fluorinated alkane, and chlorofluorocarbon; silicon oil and waxes; polyethylene wax, branched paraffin wax and oil; stearic acid amid, or mixtures thereof. Commercial carrier liquids are available from EXXON CORPORATION, including ISOPAR G, ISOPAR H, ISOPAR K, ISOPAR L, ISOPAR M, ISOPAR V, NORPAR 12, and NORPAR15.

A general content of the carrier liquid in the liquid toner composition ranges from 10-100 weight parts with respect to 1 weight part of the colorant. If the weight percentage of the carrier liquid is less than 10 weight parts, the content of the toner particles is relatively increased, and viscosity of the liquid toner is increased. In such a case, it becomes very difficult to control the liquid toner, and sometimes an image is printed in a non-image area where the image is not supposed to be formed. On the other hand, if the weight percentage of the carrier liquid is greater than 100 weight parts, the content of the colorant is relatively decreased and thus, the density of the colorant is decreased. Thus, the OD of the image area of a printed image is lowered, and the liquid toner is quickly consumed and needs to be replaced often.

As described above, the toner organosol, including the dispersion assistant agent and the photoreactive catalyst, is able to maintain a certain level of the dispersibility for an extended period of time, and the physical properties of the liquid toner itself are rarely affected by the organosol. Unlike the related art toner organosol, the toner organosol of embodiments of the present invention has a lower viscosity toward the fixing roller, so that it may prevent deterioration of the print quality.

The following examples will now explain the preparation process of the liquid toner composition according to an embodiment of the present invention.

EXAMPLES

Experimental Example

Preparation of Graft Stabilizer 2557 g of NORPAR12 (available from EXXON CORPORATION), 839 g of TCHMA (trimethylcyclohexyl methacrylate), 27 g of HEMA (2-hydroxyethyl methacrylate), and 13 g of V601 (a polymerization initiator, available from WACO CHEMICALS, Japan, dimethyl 2,2'-azobis(2-methylpropyonate)) were blended and stirred at 250 rpm under a nitrogen atmosphere at 70° C. for 16 hours. Then, the reaction mixture was stirred again at 250 rpm at 90° C., and was heated for one hour to remove the remaining V601.

Added to the reaction mixture were 14 g of DBTDL (dibutyltin dilaurate), and 41 g of TMI (3-isoprophenyl dimethylbenzyl isocyanates, available from SITEC INC.), and the resulting mixture was stirred at 250 rmp under a nitrogen atmosphere at 70° C. and was subjected to a reaction for 6 hours to prepare a graft stabilizer.

In particular, the graft stabilizer prepared here is a HEMA copolymer having TCHMA and TMI side branches.

Preparation of Organosol 187 g of the graft stabilizer, 2934 g of NORPAR12, 325 g of EMA (ethyl methacrylate), 49 g of EA (ethyl acrylate), and 6 g of V601 (available from WACO CHEMICALS) were blended and stirred at 250 rmp under a nitrogen atmosphere at 70° C. for 16 hours to prepare a mixture including an organosol. Next, the mixture was cooled to room temperature.

350 g of n-heptane was added to the cooled organosol, and the remaining monomers were removed from the resulting mixture with the aid of a rotary vacuum evaporator mounted with a dry ice/acetone condenser and operating at 97° C. under a 15 mm Hg vacuum condition, to obtain a desired organosol.

Next, the organosol was cooled to room temperature, and became an opaque liquid dispersion.

Preparation of Dispersion Assistant Agent

A dispersion assistant agent is prepared as described in the preparation of the graft stabilizer of Experimental Example.

Preparation of Liquid Toner Composition 9.43 g of P.B. 15:4 (available from SUN CHEMICAL INC.), 435.2 g of the organosol (% of solid=13%), 2.75 g of zirconium HEX-XEM (2.4%), 26.6 g of the dispersion assistant agent (% of solid=25%), 139.5 g of NORPAR12 (available from EXXON CORPORATION), and 0.66 g of IRGACURE 651 (available from CIBA SPECIALTY CO.) were put in an atritor type milling bottle, and 1200 g of zirconium beads was added thereto. The resulting mixture was stirred at 5000 rmp at 42° C. for 3 hours, to obtain approximately 600 g of a liquid toner composition.

Comparative Example

Approximately 600 g of a liquid toner composition were prepared as described in the preparation process for the liquid toner composition of the Experimental Example, except that IRGACURE 651 were omitted.

Evaluation

Evaluation Methods (1) Measurement of Particle Size

With the aid of HORIBA 910, a volume average particle size and an average particle size of the liquid toner compositions (from the Experimental and Comparative Examples) immediately after their preparations were measured. The liquid toner compositions were left inside a 50° C. oven for 6 days. Later, a volume average particle size and a number average particle size of the liquid toner compositions from the oven were measured.

(2) Measurement of Electrical Properties

Particularly, Q/M (charge per liquid toner unit weight) of the liquid toner compositions from the Experimental and Comparative Examples were measured immediately after their preparations, and after a 6-day stay in a 50° C. oven.

To measure Q/M, a liquid toner that was diluted to a predetermined concentration was disposed between an ITO (Indium Tin Oxide) glass and an iron plate, and a 300 kV/m of electric field was applied thereto, to dry the liquid toner adsorbed onto the ITO glass. Next, the weight of the dry toner was measured, and an applied current therebetween was calculated to obtain the quantity of electric charge per unit weight (μC/g).

(3) Measurement of Optical Density

The liquid toner was developed onto an organic photosensitive drum, and an image on the drum was taped, to measure optical density of an image area and a non-image area.

(4) Evaluation of Storage Stability at High-Temperature

The liquid toner compositions from the Experimental and Comparative Examples were left inside a 50° C. for 6 days. Six days later, a total weight of the remaining liquid toner (X), a weight of the remaining ink lump (Y), and a weight of the remaining ink lump (Z) after the liquid toner was stirred at 600 rpm for five minutes were measured, to calculate a percentage of solid and a redispersibility.

$$\text{Rate of Solidification}=Y/X\times 100(\%)$$

$$\text{Redispersibility}=(Y-Z)N\times 100(\%)$$

(5) Observation of Fixing Offset Error

Figure 2:
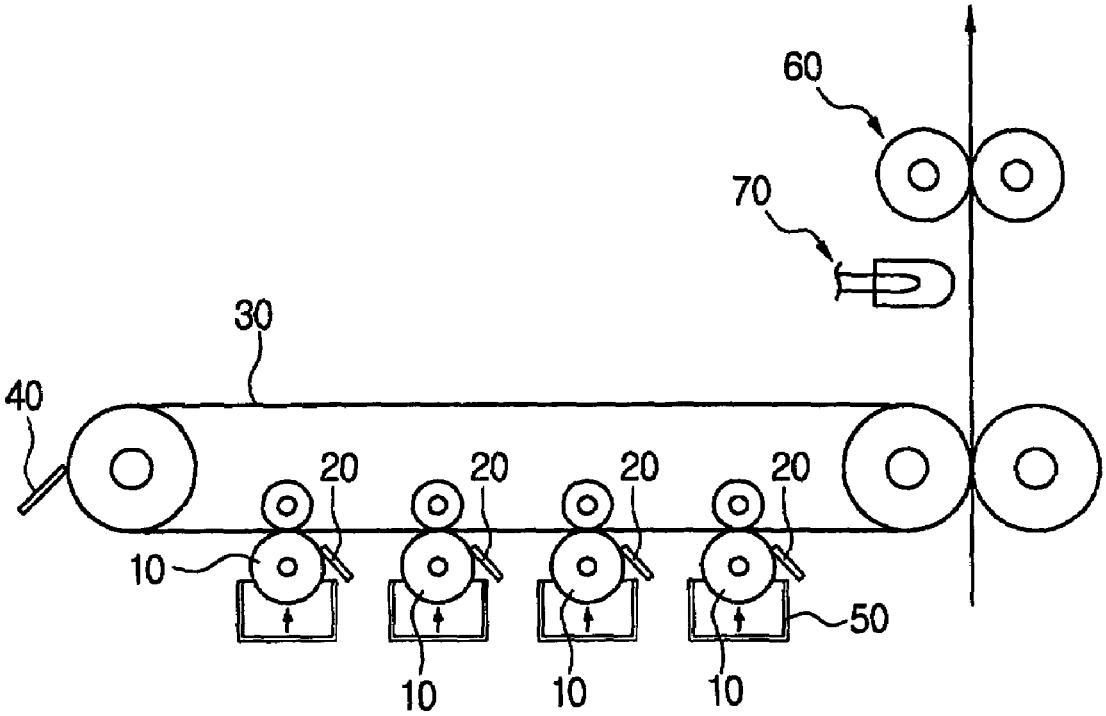
FIG. 2 is a schematic diagram of a wet electrophotographic image forming apparatus for use in an experiment of physical properties of a liquid toner composition, according to an embodiment of the present invention.

With the aid of a wet electrophotographic image forming apparatus shown in FIG. 2, a fixing offset error of the liquid toner (ink) composition was observed, which was achieved by installing a metal halide UV lamp 70 having an intensity of 120 w/in$^2$ in the front end of the fixing roller 60 inside of a laser printer, and driving the printer using the liquid toner compositions from the Experimental and Comparative Examples. Particularly, the offset error was measured in a fixing operation.

Evaluation Result

Table 1 below shows the evaluation result of physical properties for the liquid toner compositions prepared in the Experimental and Comparative Examples.

TABLE 1

| | Volume Average particle size (μm) | | Number average particle size (μm) | | Q/M (μC/g) | | | | OD in image area | | OD in non-image area | | |
|---|---|---|---|---|---|---|---|---|---|---|---|---|---|
| Result | Right after prep. | After storing at high-temp | Right after prep. | After storing at high-temp | Right after prep. | After storing at high-temp | % of rate of solidification | Re-Dispersibility (%) | Right after prep. | After storing at high-temp | Right after prep. | After storing at high-temp | Offset error (Y/N) |
| Ex | 3.40 | 3.44 | 0.24 | 0.24 | 265 | 232 | 21 | 84 | 1.80 | 1.81 | 0.01 | 0.01 | None |
| Comparative example | 3.55 | 3.60 | 0.24 | 0.24 | 273 | 230 | 20 | 85 | 1.82 | 1.80 | 0.00 | 0.01 | Yes |

As shown in Table 1, physical properties of the liquid toner compositions right after the preparation are not much different from those of the liquid toner compositions after being stored at high temperature. Therefore, the photoreactive catalyst (or the photoreactive catalyst) included in the liquid toner composition according to an embodiment of the present invention rarely affects the physical properties of the toner.

Meanwhile, the fixing offset error was observed in the fixing roller if the liquid toner composition prepared in the Comparative Example is used for printing, but not in the fixing roller if the liquid toner composition prepared in the Experimental Example is used for printing.

In conclusion, the toner organosol, including the dispersion assistant agent having an unsaturated functional group, and the photoreactive catalyst do not deteriorate any of the physical properties required for the proper performance of the liquid toner, and remove the offset error in the fixing operation, resulting in an improved quality of a printed image.

The foregoing embodiment and advantages are merely exemplary and are not to be construed as limiting the present invention. The present teaching may be readily applied to other types of apparatuses. It would be appreciated by those skilled in the art that changes may be made in this embodiment without departing from the principles and spirit of the invention, the scope of which is defined in the claims and their equivalents.

What is claimed is:

1. A liquid toner composition, comprising:

a colorant;

an organosol;

a charge control agent;

a carrier liquid;

a dispersion assistant agent; and a photoreactive catalyst, wherein the dispersion assistant agent is a polymer including an unsaturated functional group to cause photopolymerization in a presence of the photoreactive catalyst, and the photoreactive catalyst produces a free radical through an irradiation of a light, and initiates the photopolymerization of the dispersion assistant agent.

2. The liquid toner composition according to claim 1, wherein an amount of the organosol is within a range from 1 weight part to 20 weight parts with respect to 1 weight part of the colorant, an amount of the charge control agent is within a range from 0.001 weight part to 1 weight part with respect to 1 weight part of the colorant; an amount of the carrier liquid is within a range from 10 weight parts to 100 weight parts with respect to 1 weight part of the colorant, an amount of the dispersion assistant agent is within a range from 1 weight part to 20 weight parts with respect to 100 weight parts of a total weight of the colorant and the organosol, and an amount of the photoreactive catalyst is within a range from 1 weight part to 10 weight parts with respect to 100 weight parts of the dispersion assistant agent.

3. The liquid toner composition according to claim 1, wherein the dispersion assistant agent is a polymer soluble in the carrier liquid, and includes a repetitive unit derived from $C_6$-$C_{30}$ (metha)acryl monomers.

4. The liquid toner composition according to claim 3, wherein a weight average (Mw) molecular weight of the dispersion assistant agent, including a repetitive unit derived from a $C_6$-$C_{30}$ (metha)acryl monomer, is in a range from 100,000 to 300,000.

5. The liquid toner composition according to claim 3, wherein the $C_6$-$C_{30}$ (metha)acryl monomer is selected from the group consisting of hexyl(metha)acrylate, 2-ethylhexyl (metha)acrylate, 2-hydroxyethyl methacrylate, decyl(metha) acrylate, dodecyl acrylate, lauryl acrylate, octadecyl acrylate, stearyl acrylate, behenyl acrylate, and trimethyl cyclohexyl methacrylate.

6. The liquid toner composition according to claim 1, wherein the photoreactive catalyst is selected from the group consisting of benzoin butyl ether, benzyl dimethyl ketal, α-aminoacetophenone, ethoxyacetophenone, acyloxime ester, chlorinated acetophenone, hydroxyacetophenone, phenylphospine oxide, acylphospine oxide, phosphine oxide, benzophenone, Michlers Ketone, dibenzosuberone, 2-ethylanthraquinone, isobutylthioxanthone, isopropylthioxanthone, benzyl, and thioxanthone.

7. The liquid toner composition according to claim 6, wherein the photoreactive catalyst is selected from the group consisting of benzyl dimethyl ketal, mixtures of benzyl dimethyl ketal and phosphine oxide, and mixtures of α-aminoacetophenone and thioxanthone.

8. The liquid toner composition according to claim 1, wherein the organosol comprises a thermoplastic (co)polymer core that is insoluble in the carrier liquid, and a (co)polymer graft stabilizer that is covalently bonded to the thermoplastic (co)polymer core, and a mixture ratio of the (co)polymer core to the (co)polymer graft stabilizer is in a range from 1:1 to 15:1.

9. The liquid toner composition according to claim 8, wherein the (co)polymer core-forming monomer is a $C_4$-$C_{30}$ (metha)acrylate monomer, and the (co)polymer graft stabilizer-forming monomer is a $C_6$-$C_{30}$ (metha)acrylate monomer.

10. A preparation method of a liquid toner composition, the method comprising:

preparing a graft stabilizer by blending in a first carrier liquid a graft stabilizer-forming $C_6$-$C_{30}$ (metha)acrylate monomer and a first polymerization initiator to cause polymerization;

preparing an organosol by blending in a second carrier liquid the graft stabilizer, a thermoplastic (co)polymer core-forming $C_4$-$C_{30}$ (metha)acrylate monomer and a second polymerization initiator to cause polymerization;

preparing a dispersion assistant agent by blending in a third carrier liquid a dispersion assistant agent-forming $C_6$-$C_{30}$ (metha)acrylate monomer and a third polymerization initiator to cause polymerization; and blending in a fourth carrier liquid a colorant, the organosol, a charge control agent, the dispersion assistant agent, and a photoreactive catalyst.

11. The method according to claim 10, wherein the dispersion assistant agent-forming $C_6$-$C_{30}$ (metha)acrylate monomer is soluble in the fourth carrier liquid, and the dispersion assistant agent comprises an unsaturated functional group.

12. The method according to claim 10, wherein the photoreactive catalyst is selected from the group consisting of benzoin butyl ether, benzyl dimethyl ketal, α-aminoacetophenone, ethoxyacetophenone, acyloxime ester, chlorinated acetophenone, hydroxyacetophenone, phenylphospine oxide, acylphospine oxide, phosphine oxide, benzophenone, Michlers Ketone, dibenzosuberone, 2-ethylanthraquinone, isobutylthioxanthone, isopropylthioxanthone, benzyl, and thioxanthone.

13. The method according to claim 12, wherein the photoreactive catalyst is selected from the group consisting of benzyl dimethyl ketal, mixtures of benzyl dimethyl ketal and phosphine oxide, and mixtures of α-aminoacetophenone and thioxanthone.

14. The method according to claim 10, wherein an amount of the organosol is within a range from 1 weight part to 20 weight parts with respect to 1 weight part of the colorant, an amount of the charge control agent is within a range from 0.001 weight part to 1 weight part with respect to 1 weight part of the colorant; an amount of a total carrier liquid comprising the first carrier liquid plus the second carrier liquid plus the third carrier liquid plus the fourth carrier liquid is within a range from 10 weight parts to 100 weight parts with respect to 1 weight part of the colorant, an amount of the dispersion assistant agent is within a range from 1 weight part to 20 weight parts with respect to 100 weight parts of a total weight of the colorant and the organosol, and an amount of the photoreactive catalyst is within a range from 1 weight part to 10 weight parts with respect to 100 weight parts of the dispersion assistant agent.

15. The method according to claim 10, wherein a weight average (Mw) molecular weight of the dispersion assistant agent is in a range from 100,000 to 300,000.

16. The method according to claim 10, wherein the $C_6$-$C_{30}$ (metha)acryl monomer is selected from the group consisting of hexyl(metha)acrylate, 2-ethylhexyl(metha) acrylate, 2-hydroxyethyl methacrylate, decyl(metha)acrylate, dodecyl acrylate, lauryl acrylate, octadecyl acrylate, stearyl acrylate, behenyl acrylate, and trimethyl cyclohexyl methacrylate.

17. The method according to claim 10, wherein a mixture ratio of the thermoplastic (co)polymer core-forming $C_4$-$C_{30}$ (metha)acrylate monomer to the graft stabilizer-forming $C_6$-$C_{30}$ (metha)acrylate monomer is in a range from 1:1 to 15:1.

* * * * *